US007498937B2

(12) United States Patent
Martin et al.

(10) Patent No.: US 7,498,937 B2
(45) Date of Patent: Mar. 3, 2009

(54) A-Z LOCATOR

(76) Inventors: Errol Martin, 1976 Checkerboard Blvd., Beaufort, SC (US) 29906; Maria Martin, 1976 Checkerboard Blvd., Beaufort, SC (US) 29906

( * ) Notice: Subject to any disclaimer, the term of this patent is extended or adjusted under 35 U.S.C. 154(b) by 285 days.

(21) Appl. No.: 11/594,381

(22) Filed: Nov. 8, 2006

(65) Prior Publication Data

US 2007/0103293 A1 May 10, 2007

Related U.S. Application Data

(60) Provisional application No. 60/734,419, filed on Nov. 8, 2005.

(51) Int. Cl.
*G08B 1/08* (2006.01)

(52) U.S. Cl. ..... 340/539.1; 340/539.15; 340/539.13; 340/539.11; 340/568.1; 340/571; 340/573.1; 340/573.4; 342/357.07; 342/357.09

(58) Field of Classification Search ..... 340/539.1, 340/539.11, 539.13, 539.15, 568.1, 571, 340/573.1, 573.4; 342/357.07, 357.09; 370/312, 370/313; 455/456, 457
See application file for complete search history.

(56) References Cited

U.S. PATENT DOCUMENTS 5,838,237 A 11/1998 Revell et al.
6,362,778 B2 3/2002 Neher
6,388,612 B1 5/2002 Neher
6,593,851 B1 7/2003 Bornstein
2006/0267760 A1 * 11/2006 Shecter ..... 340/539.15

* cited by examiner

*Primary Examiner*—Hung T. Nguyen
(74) *Attorney, Agent, or Firm*—James Ray & Assoc.

(57) ABSTRACT

An A-Z locator for transmitting and receiving signals and a portable device for transmitting and receiving signals. A position identifier for communicating with a Global Positioning System to determine a location of the A-Z Locator. A transmitter for transmitting a signal to the portable device. A GPS converter for converting such location to a communication signal. A receiver for receiving vocal communication having an electrical connection to a vocal converter for converting the vocal communication to a signal. Pushbuttons for initiating a signal for communication to the portable device and activating such vocal receiver. A transmitter for transmitting a communication signal. A receiver for receiving a communication signal. A converter for converting the signal to vocal communication. An amplifier for amplification of such vocal communication. A speaker for emitting such vocal communication. Pushbuttons for initiating a signal to be communicated to a predetermined location and for activating the vocal receiver.

20 Claims, 2 Drawing Sheets

A-Z LOCATOR

CROSS-REFERENCE TO RELATED APPLICATIONS

This application is related to and claims priority from U.S. Provisional Patent Application Ser. No. 60/734,419 having a filing date of Nov. 8, 2005.

FIELD OF THE INVENTION

The present invention generally relates to locating and communications system. More particularly, the invention relates to a child locating system that allows one-way communication from child to parent and from parent to police.

BACKGROUND OF THE INVENTION

Children are abducted daily and often by force. Strangers, friends or even family members abduct children. Some children simply wander away from adults becoming afraid, confused, and disoriented. Even when playing in known or visible areas, children can easily become lost or simply vanish. In any case, time is of the essence. Children not reported missing and found quickly may never be found. Thus, it is desirable to be able to locate and communicate with children who become separated from their parents.

SUMMARY OF THE INVENTION

In one aspect, the invention generally features a means suitable for wear by an individual for transmitting and receiving wireless signals in combination with a portable means for transmitting and receiving wireless signals. A housing portion disposed on such means suitable for wear is used for containing circuitry and graphic display therein. A pair of bands, each of such pair of bands is engageable at a respective first end thereof with such housing for holding the means suitable for wear in place. A pair of clasp means engageable at a respective end thereof with a respective second end of such pair of bands holds the pair of bands together. A locking means engageable with such pair of clasp means locks the pair of clasps means together. Such locking means has an aperture of a predetermined size and pattern. A position identification means is disposed within such housing for communicating with a Global Positioning System (GPS) to determine a location of the A-Z Locator. A transmission means is disposed within such housing for transmitting a wireless communication signal to the portable means. A GPS conversion means is disposed within the housing for converting such location determined to a wireless communication signal. A vocal receiving means is disposed within such housing for receiving vocal communication, the vocal receiving means having an electrical connection to a vocal conversion means for converting the vocal communication to a wireless signal. A first pushbutton disposed on such housing is used for initiating a wireless signal to be communicated to the portable means. A second pushbutton disposed on the housing is for activating such vocal receiving means. An enclosure portion of the portable means is for circuitry containment, the enclosure portion includes a first housing portion and a second housing portion. A first housing portion of the enclosure portion contains a predetermined number of apertures engageably connected to a second housing portion of such enclosure portion. A transmission means is disposed within such enclosure portion for transmitting a wireless communication signal. A reception means is disposed within the enclosure portion for receiving a wireless communication signal. A vocal conversion means is disposed within such enclosure portion for converting the wireless signal to vocal communication. An amplifier means is disposed within the enclosure portion for amplification of such vocal communication. A speaker portion is disposed within the enclosure portion for emitting such vocal communication thru the apertures formed in such enclosure portion. A first pushbutton disposed on such enclosure is for initiating a wireless signal to be communicated to a predetermined location. A second pushbutton disposed on such enclosure is used for activating the vocal receiving means. Finally, a key is included for locking and unlocking the locking means, and such key has a first end engageable with the aperture disposed within such locking means.

OBJECTS OF THE INVENTION

It is therefore one of the primary objects of the present invention to provide an A-Z Locator that detects a child's location and allows one-way communications.

Another object of the present invention is to provide an A-Z Locator that allows distress signals to be transmitted.

A further object of the present invention is to provide an A-Z Locator that allows distress signals to be received.

Yet another object of the present invention is to provide an A-Z Locator that is not easily removed by children or adults.

Still another object of the present invention is to provide an A-Z Locator that has the appearance of a wrist watch.

In addition to the above-described objects and advantages of the present invention described above, it should be noted that various other objects and advantages of the present invention will become more readily apparent to those persons who are skilled in the same and related arts from the following more detailed description of the invention, particularly, when such description is taken in conjunction with the attached drawing figures and with the appended claims.

DETAILED DESCRIPTION OF THE PRESENTLY PREFERRED EMBODIMENT

Figure 1:
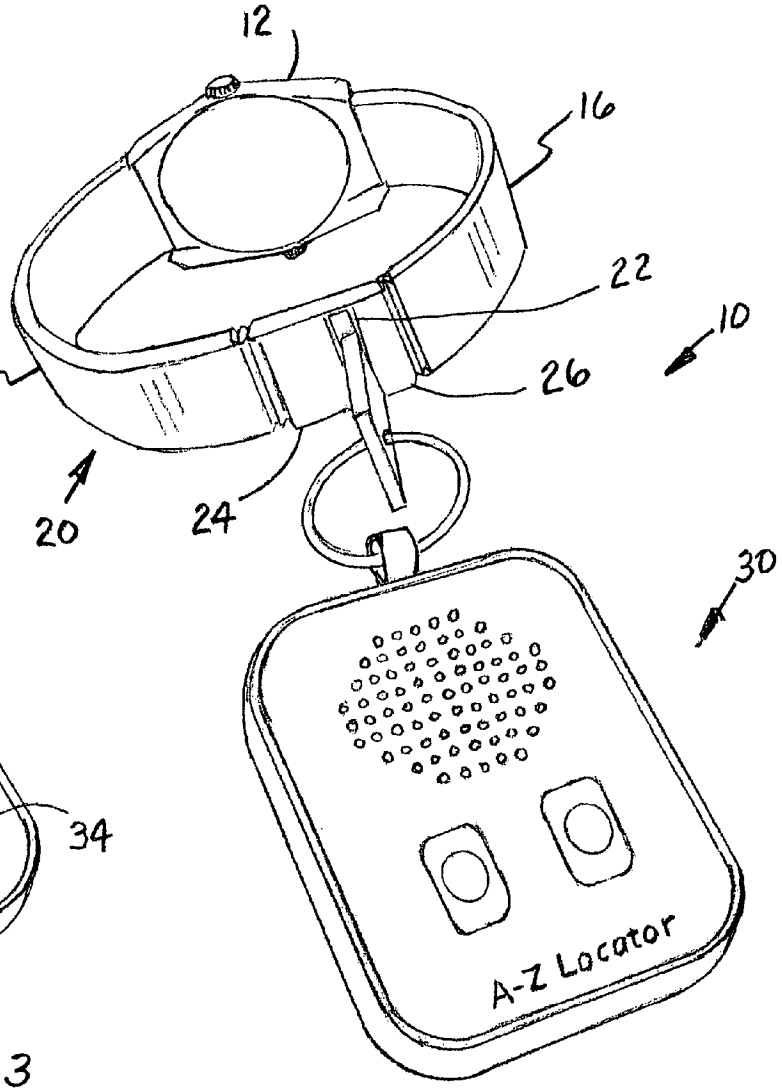
FIG. 1 is a perspective view of the A-Z Locator showing the wearable portion, the portable portion and the means for locking and unlocking the latch of the wearable portion of the A-Z locator worn by a child.
Figure 3:
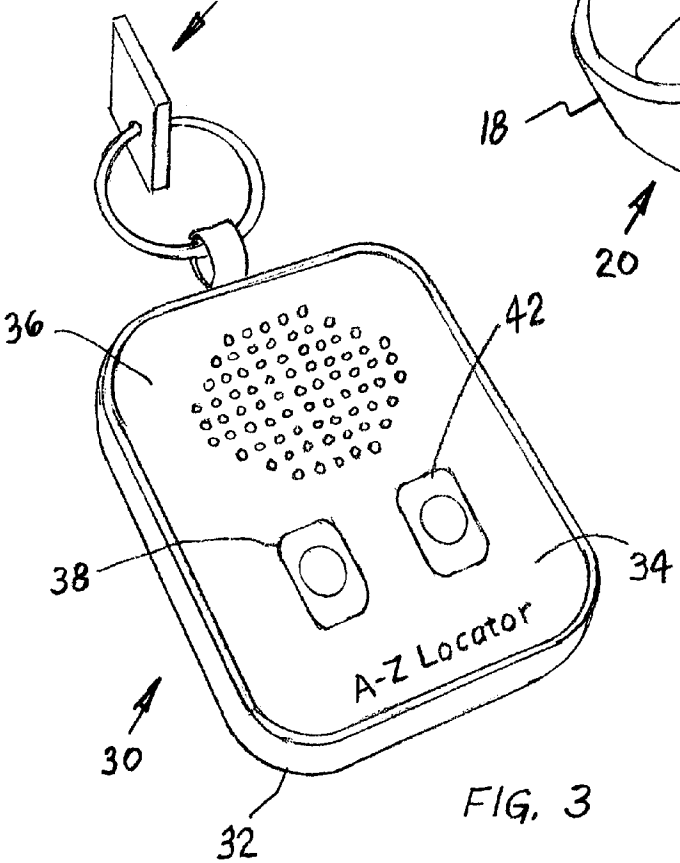
FIG. 3 is a perspective top view of the portable portion of the A-Z Locator carried by parents.
Figure 2:
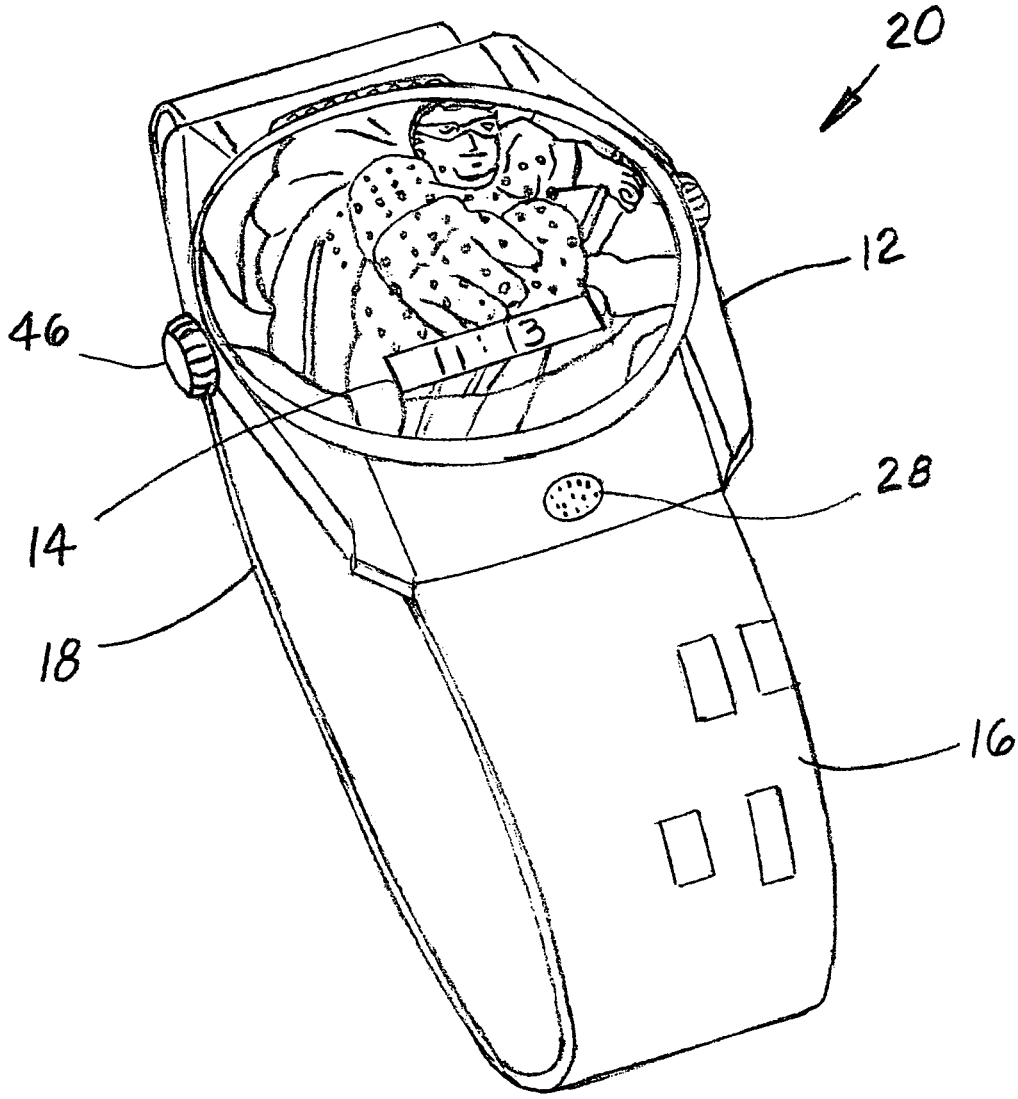
FIG. 2 is a perspective top view of the wearable portion of the A-Z Locator worn by a child showing it's similarity to a wrist watch.

Prior to proceeding to a much more detailed description of the present invention, it should be noted that identical components which have identical functions have been identified with identical reference numerals throughout the several views illustrated in the drawing figures for the sake of clarity and understanding of the invention.

Referring initially to FIG. 1 an A-Z Locator constructed according to a presently preferred embodiment of the invention is generally indicated by reference numeral 10. The A-Z Locator (10) further includes a means suitable for wear (20) by an individual for transmitting and receiving wireless signals and a portable means (30) for transmitting and receiving wireless signals.

The means suitable for wear (20) includes a housing portion (12) for containing circuitry (not shown) and a graphic display (14) therein. A position identification means (not shown) is disposed within housing (12) for communicating with a Global Positioning System (GPS) to determine the location of the A-Z Locator (10). A GPS conversion means (not shown) is disposed within the housing (12) and converts the location that has been determined to a wireless communication signal. A transmission means (not shown) is disposed within housing (12) for transmitting a wireless communication signal to the portable means (30). A vocal receiving means (not shown) is disposed within the housing (12) for receiving vocal communication. The vocal receiving means has an electrical connection to a vocal conversion means that converts the vocal communication received to a wireless signal.

A pair of bands (16, 18) are engageable at a respective first end thereof with housing (12) which are used to hold such means suitable for wear (20) in place. A pair of clasp means (24, 26) engageable at a respective end thereof with a respective second end of the pair of bands (16, 18) are for holding the pair of bands (16, 18) together. There is a locking means (22) engageable with such pair of clasp means which locks the clasp means (24, 26) together. The locking means (22) includes an aperture of a predetermined size and pattern.

A first pushbutton (46) is disposed on housing (12) and initiates a wireless signal to be communicated to the portable means (30). A second pushbutton (28) is disposed on such housing (12) for activating the vocal receiving means.

The housing (12), pair of bands (16, 18), first clasp means (24), the second clasp means (26), and the locking means (22) are made of a plastic material highly resistant to breaking and cutting.

The wearable portion (20) closely resembles a child's wristwatch and may be decorated with predetermined designs having a children's motif similar to those found on children's wristwatches.

The portable means (30) includes an enclosure portion (32) for circuitry containment, and includes a first housing portion (34) and a second housing portion (36). The first housing portion (34) contains a predetermined number of apertures and is engageably connected to the second housing portion (36) of enclosure portion (32). The portable portion (30) closely resembles a key fob and further includes an aperture for engagement with one of a key ring and a key chain.

A transmission means (not shown) is disposed within enclosure portion (32) for transmitting a wireless communication signal. A reception means (not shown) is disposed within the enclosure portion for receiving a wireless communication signal. A vocal conversion means (not shown) is disposed within enclosure portion (32) for converting a wireless signal to vocal communication.

An amplifier means (not shown) is disposed within enclosure portion (32) for amplification of the converted vocal communication. A speaker portion (not shown) is disposed within enclosure portion (32) for emitting said vocal communication thru said apertures formed in said enclosure portion (32) so that it may be heard by the user of portable portion (30).

A first pushbutton (38) is disposed on enclosure (32) for initiating a wireless signal to be communicated to a predetermined location. A second pushbutton (42) is disposed on said enclosure (32) for activating the vocal receiving means.

A key (40) for locking and unlocking locking means (22), has a first end engageable with the aperture disposed within locking means (22). Such key (40) further includes an aperture for engagement with one of a key ring and a key chain.

The A-Z locator (10) further includes an antenna (not shown) disposed within housing (12) for improving the reception and transmission of signals. There is an identification means (not shown) disposed within housing (12) and having an electrical connection to the antenna. Each of the transmission means, reception means, GPS conversion system and the vocal conversion means are electrically connected to this antenna. The A-Z Locator (10) may include a clock (not shown) for displaying time. The clock is disposed within housing (12). The display means (14) of the clock is shown in FIG. 1.

The A-Z Locator (10) includes a first power means (not shown). The first power means is at least one of a battery, a solar cell, and a piezoelectric device. In a preferred embodiment, the first power means is a battery.

The A-Z Locator (10) has a second power means (not shown). The second power means is at least one of a battery, a solar cell, and a piezoelectric device. In a preferred embodiment, the second power means is a battery.

The predetermined location of the wireless signal initiated by second pushbutton (38) disposed on enclosure (32) is one of a police department or a call center. In a preferred embodiment, the predetermined location of the wireless signal initiated by such second pushbutton (38) disposed on enclosure (32) is preferably a call center.

While the present invention has been described by way of a detailed description of a particularly preferred embodiment, it will be readily apparent to those of ordinary skill in the art that various substitutions of equivalents may be affected without departing from the spirit or scope of the invention set forth in the appended claims.

We claim:

1. In combination with a means suitable for wear by an individual for transmitting and receiving wireless signals and a portable means for transmitting and receiving wireless signals, the improvement comprising an A-Z locator including:

(a) a housing portion disposed on said means suitable for wear for containing circuitry and graphic display therein;

(b) a pair of bands, each of said pair of bands engageable at a respective first end thereof with said housing for holding said means suitable for wear in place;

(c) a pair of clasp means engageable at a respective end thereof with a respective second end of said pair of bands for holding said pair of bands together;

(d) a locking means engageable with said pair of clasp means for locking said pair of clasps means together, said locking means having an aperture of a predetermined size and pattern;

(e) a position identification means disposed within said housing for communicating with a Global Positioning System (GPS) to determine a location of said A-Z Locator;

(f) a transmission means disposed within said housing for transmitting a wireless communication signal to said portable means;

(g) a GPS conversion means disposed within said housing for converting said location determined to a wireless communication signal;

(h) a vocal receiving means disposed within said housing for receiving vocal communication, said vocal receiving means having an electrical connection to a vocal conversion means for converting said vocal communication to a wireless signal;

(i) a first pushbutton disposed on said housing for initiating a wireless signal to be communicated to said portable means;

(j) a second pushbutton disposed on said housing for activating said vocal receiving means;

(k) an enclosure portion of said portable means for circuitry containment, said enclosure portion including a first housing portion and a second housing portion;

(l) said first housing portion of said enclosure portion containing a predetermined number of apertures engageably connected to said second housing portion of said enclosure portion;

(m) a transmission means disposed within said enclosure portion for transmitting a wireless communication signal;

(n) a reception means disposed within said enclosure portion for receiving a wireless communication signal;

(o) a vocal conversion means disposed within said enclosure portion for converting said wireless signal to vocal communication;

(p) an amplifier means disposed within said enclosure portion for amplification of said vocal communication;

(q) a speaker portion disposed within said enclosure portion for emitting said vocal communication thru said apertures formed in said enclosure portion;

(r) a first pushbutton disposed on said enclosure for initiating a wireless signal to be communicated to a predetermined location;

(s) a second pushbutton disposed on said enclosure for activating said vocal receiving means; and (t) a key for locking and unlocking said locking means, said key having a first end engageable with said aperture disposed within said locking means.

2. The combination, according to claim 1, wherein said A-Z locator further includes an antenna disposed within said housing for improving the reception and transmission of signals.

3. The combination according to claim 2, wherein said A-Z locator further includes an identification means disposed within said housing and having an electrical connection to said antenna.

4. The combination according to claim 3, wherein each of said transmission means and said GPS conversion system and said vocal conversion means are electrically connected to said antenna.

5. The combination according to claim 4, wherein said enclosure portion includes an antenna for improving reception and transmission of signals.

6. The combination according to claim 5, wherein each of said transmission means and said reception means and said vocal conversion means includes an electrical connection to said antenna disposed within said enclosure portion.

7. An A-Z Locator according to claim 1, wherein a clock for displaying time is disposed within said housing.

8. An A-Z Locator according to claim 1, wherein said first power means is at least one of a battery, a solar cell, and a piezoelectric device.

9. An A-Z Locator according to claim 8, wherein said first power means is preferably a battery.

10. An A-Z Locator according to claim 1, wherein said second power means is at least one of a battery, a solar cell, and a piezoelectric device.

11. An A-Z Locator according to claim 10, wherein said second power means is preferably a battery.

12. An A-Z Locator according to claim 11, wherein said wearable portion is decorated with predetermined designs.

13. An A-Z Locator according to claim 11, wherein said predetermined designs have a children's motif similar to those found on children's wristwatches.

14. An A-Z Locator according to claim 11, wherein said key fob further includes an aperture for engagement with one of a Key ring and a key chain.

15. An A-Z Locator according to claim 1, wherein said predetermined location of said wireless signal initiated by said third pushbutton is one of a police department or a call center.

16. An A-Z Locator according to claim 15, wherein said predetermined location of said wireless signal initiated by said second pushbutton is preferably a call center.

17. An A-Z Locator according to claim 1, wherein said housing, said pair of bands, said first clasp means and said second clasp means, and said locking means are made of a plastic material highly resistant to breaking and cutting.

18. An A-Z Locator according to claim 1, wherein said wearable portion closely resembles a child's wristwatch.

19. An A-Z Locator according to claim 1, wherein said portable portion closely resembles a key fob.

20. An A-Z Locator according to claim 1, wherein said key further includes an aperture for engagement with one of a key ring and a key chain.

* * * * *